US012369625B2

(12) United States Patent
Akhtari et al.

(10) Patent No.: US 12,369,625 B2
(45) Date of Patent: Jul. 29, 2025

(54) SMOKING APPARATUS PROVIDING ENHANCED COOLING

(71) Applicants: Massoud Akhtari, Mill Valley, CA (US); Teis Nezam Tolstrup Akhtari, Mill Valley, CA (US)

(72) Inventors: Massoud Akhtari, Mill Valley, CA (US); Teis Nezam Tolstrup Akhtari, Mill Valley, CA (US)

( * ) Notice: Subject to any disclaimer, the term of this patent is extended or adjusted under 35 U.S.C. 154(b) by 0 days.

(21) Appl. No.: 17/724,424

(22) Filed: Apr. 19, 2022

(65) Prior Publication Data

US 2023/0329330 A1 Oct. 19, 2023

(51) Int. Cl.
*A24F 1/32* (2006.01)
*A24F 1/12* (2006.01)
*A24F 1/16* (2006.01)

(52) U.S. Cl.
CPC ..... *A24F 1/12* (2013.01); *A24F 1/16* (2013.01); *A24F 1/32* (2013.01); *A24F 2700/03* (2013.01); *A24F 2700/04* (2013.01)

(58) Field of Classification Search
CPC ..... A24F 1/02; A24F 1/12; A24F 1/16; A24F 1/32
See application file for complete search history.

(56) References Cited

U.S. PATENT DOCUMENTS 800,730 A * 10/1905 Felton ..... A24F 1/22 131/197
2,098,983 A * 11/1937 Uber ..... A24F 1/00 131/195
2,263,464 A * 11/1941 Lackow ..... A24F 1/00 131/194
2,830,598 A * 4/1958 Cheng ..... A24F 7/04 131/194
2016/0044960 A1* 2/2016 O'Connor ..... A24F 1/00 131/200
2017/0245545 A1* 8/2017 Johnson, III ..... A24F 1/00
2018/0098567 A1* 4/2018 Dunlap ..... A24F 1/16
2021/0059297 A1* 3/2021 Fernando ..... A24F 5/04
2021/0298352 A1* 9/2021 Arabia ..... A24F 40/57

FOREIGN PATENT DOCUMENTS

GB 1020992 A * 2/1966 ..... A24F 1/02

* cited by examiner

*Primary Examiner* — Eric Yaary
(74) *Attorney, Agent, or Firm* — Stradling Yocca Carlson & Rauth

(57) ABSTRACT

A smoking apparatus is provided. The smoking apparatus includes an organic leafy material receptacle configured to receive organic leafy material for ignition, a chamber connected to the organic leafy material receptacle by a connection tube, the chamber comprising a circulating tube configured to receive smoke from the organic leafy material receptacle via the connection tube, and at least one cooling element contacting the circulating tube, the at least one cooling element selected from the group consisting of electric cooling hardware, magnetic cooling hardware, and anhydrous cooling material contacting the circulating tube, and an inhalation tube connected to the chamber and configured to receive cooled smoke from the circulating tube. A user inhaling from the inhalation tube draws smoke from the organic leafy material receptacle to the circulating tube in the chamber to the inhalation tube and to the user.

18 Claims, 12 Drawing Sheets

SMOKING APPARATUS PROVIDING ENHANCED COOLING

BACKGROUND

I. Field

The present invention relates generally to the field of smoking devices.

II. Description of the Related Art

Smoking implements have been around for centuries. For example, pipes have been available to enable and facilitate the smoking of organic leafy materials including but not limited to tobacco.

The problem with such smoking devices is the user tends to draw in heated smoke, which can be physically detrimental. Over time, mouth, throat, esophagus, and lung issues can arise from the inhalation of heated smoke. Scarring of blood vessels can result from heated smoke inhalation over time.

Different types of pipes or other smoking devices have employed different cooling methods, including use of liquid, wherein the product is combusted and smoke drawn through water or other liquid by user inhalation. Heated smoke thus percolates through the liquid to the user. Water is typically used as the liquid, but other liquids or other substances added to water or other liquids may be employed. However, such methods tend to be relatively limited in their ability to address heat issues. Users can still experience detrimental effects from inhalation of heated smoke, as water only provides limited cooling in most applications.

It would therefore be beneficial to provide a device or design that addresses issues with previously available hardware employed for smoking organic leafy material, including the heat of the smoke inhaled by the user.

SUMMARY

According to one embodiment of the present design, there is provided a smoking apparatus comprising an organic leafy material receptacle configured to receive organic leafy material for ignition, a chamber comprising a circulating tube configured to receive smoke from the organic leafy material receptacle via a passageway, at least one cooling element contacting the circulating tube, the at least one cooling element selected from the group consisting of electric cooling hardware, magnetic cooling hardware, and anhydrous cooling material contacting the circulating tube, and an inhalation tube connected to the chamber and configured to receive cooled smoke from the chamber. A user inhaling from the inhalation tube draws smoke from the organic leafy material receptacle to the circulating tube in the chamber to the inhalation tube and to the user.

According to a further embodiment of the present design, there is provided a smoking apparatus comprising an organic leafy material receptacle configured to receive organic leafy material for ignition, a chamber connected to the organic leafy material receptacle by a connection tube, the chamber comprising a circulating tube configured to receive smoke from the organic leafy material receptacle via the connection tube, at least one cooling element contacting the circulating tube, the at least one cooling element selected from the group consisting of electric cooling hardware, magnetic cooling hardware, and anhydrous cooling material contacting the circulating tube, and an inhalation tube connected to the chamber and configured to receive cooled smoke from the circulating tube. A user inhaling from the inhalation tube draws smoke from the organic leafy material receptacle to the circulating tube in the chamber to the inhalation tube and to the user.

According to another embodiment of the present design, there is provided a smoking apparatus comprising an organic leafy material receptacle configured to receive organic leafy material for ignition, a chamber connected to the organic leafy material receptacle, the chamber comprising a passageway configured to receive smoke from the organic leafy material receptacle, at least one cooling element contacting the passageway, at least one cooling element selected from the group consisting of electric cooling hardware, magnetic cooling hardware, and anhydrous cooling material, and an inhalation element connected to the chamber and configured to receive cooled smoke from the chamber.

Various aspects and features of the disclosure are described in further detail below.

DETAILED DESCRIPTION

The present design provides a design including advanced cooling techniques and hardware that significantly cools smoke being drawn in or inhaled by the user. The design can be altered to provide additional filtration of the smoke inhaled, and various cooling methods and components may be employed. The result is the ability for the user to inhale relatively cool smoke as compared to previous designs, including those that percolate smoke through water.

Figure 1:
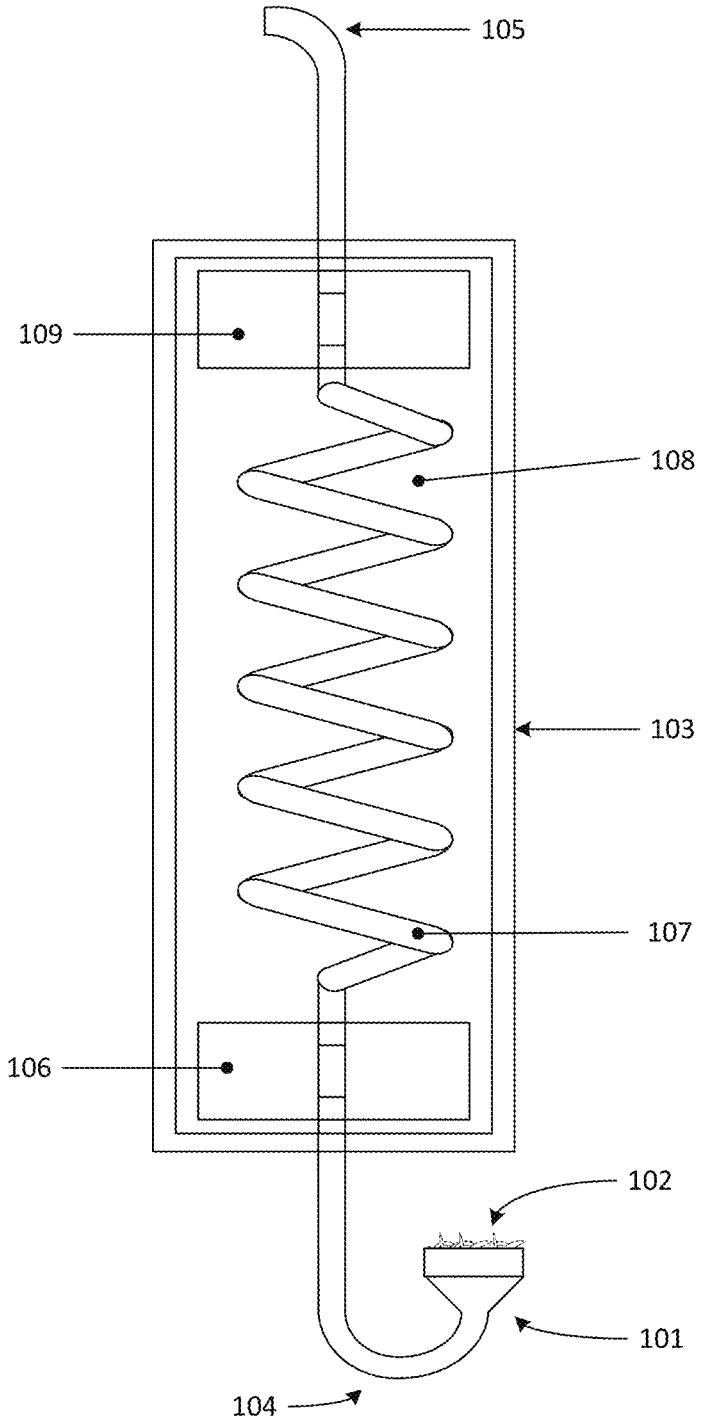
FIG. 1 illustrates an embodiment of the smoking apparatus.

FIG. 1 is a representation of one embodiment of the design. From FIG. 1, receptacle 101 receives organic leafy material 102, and is connected to housing 103 by connector 104. A user may ignite the organic leafy material 102 and may inhale, via inhalation element 105, such that smoke is drawn through connector 104 toward housing 103.

Housing 103 includes a filter 106, typically an activated charcoal and/or filtering fabric. In one embodiment, the filter may be provided in a removable orientation, such as the housing having a detachable portion that holds the filter 106, or wherein the filter 106 is accessible from the exterior, such as by a door or opening. In one embodiment, the user may have the ability to provide certain filtration components, or no filtration components, such as providing two activated charcoal disks or pieces rather than one, or more than two, or even zero. The user may provide different types of filters, combinations of different filtration elements, and so forth, or no filtration whatsoever.

Filtered smoke is received from filter 106 passes to circulating tube 107, which circulates smoke through an inner chamber 108 in a circular manner in this embodiment. Circulating tube 107 may be constructed from any appropriate material, typically material that can cool smoke passing through the interior thereof. In one embodiment, circulating tube 107 is constructed of heat conducting tubing, including but not limited to aluminum, iron, copper, or bronze. In one embodiment, boron nitride-doped plastic is employed in the construction of circulating tube 107. Different combinations of materials may be employed that are noninsulating but instead conduct heat.

In embodiments described herein, there are provided magnetic and electric cooling designs as well activated charcoal-laced cotton cloth design for a filter. However, in alternative embodiments, inner chamber 108 may include a cooling material, solid or liquid. One such material may be water and/or ice. Alternately, calcium chloride or another cooling material may be employed, including but not limited to potassium chloride, glycol, calcium magnesium acetate, and so forth.

Length of the components may vary, including lengths of housing 103, inner chamber 108, and circulating tube 107. Greater lengths of these components provide additional cooling opportunities.

Connector 104 may be made of the same or a different material as circulating tube 107, and a tube connector (not shown) between components may be provided. The heating/cooling attributes of the circulating tube 107 are not specifically required for connection 104. Inhalation element may include a mouthpiece (not shown) and may be made of different or similar materials as circulating tube 107 and connector 104, and again a tube connector (not shown) may be provided between inhalation element 105 and circulating tube 107.

Additional optional second filter 109 is shown. Such a filter may or may not be employed, and as with filter 106, the additional optional second filter may be provided in a removable orientation, such as a construction wherein housing 103 provides a detachable portion that holds additional optional second filter 109, or wherein the additional optional second filter 109 is accessible from the exterior, such as by a door or opening. The user may have the ability to provide certain additional optional second filtration components, or no additional optional second filtration components, i.e., providing two activated charcoal disks or pieces rather than one, or more than two, or even zero. The user may provide different types of additional optional second filters, combinations of different additional optional second filtration elements, such as activated charcoal and fabric, different types of fabric, and so forth, or no filtration whatsoever.

A user having lit the organic leafy material in receptacle 101 draws the smoke through filter 106 via connector 104, through filter 106, into circulating tube 107, where the smoke is cooled while passing through circulating tube 107 as a result of the user drawing smoke in and the cooling effect of the calcium chloride or other cooling solid, liquid, or combination thereof in inner chamber 108. Further filtering may occur via optional second filter 109. One or the other, or both, of filter 106 and optional second filter 109 may be omitted. Smoke drawn through inhalation element 105 is cooler than smoke drawn using previously available designs.

Circulating tube 107 is in a circular spiral or "corkscrew" shape, but other shapes may be employed. The goal is to enable the user to draw in smoke easily and quickly with sufficient cooling of the smoke being inhaled. Thus more or fewer paths may be employed and different path shapes may be offered depending on circumstances.

Figure 2:
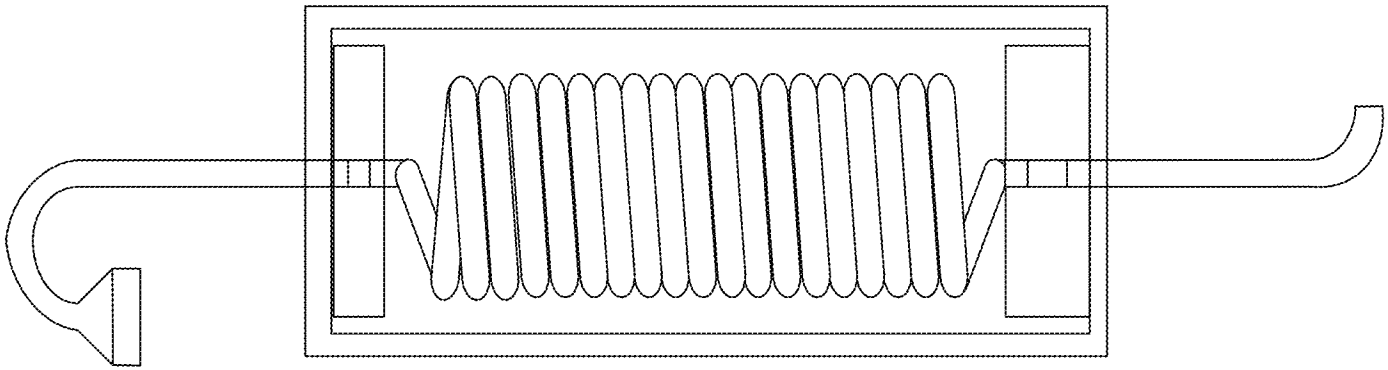
FIG. 2 shows an alternate embodiment of the smoking apparatus.

FIG. 2 presents an alternate version of the device, with tighter coils on the circulating tube. Such increased surface area may provide certain cooling advantages, but may take more effort or time to draw in smoke than the embodiment of FIG. 1.

Figure 3:
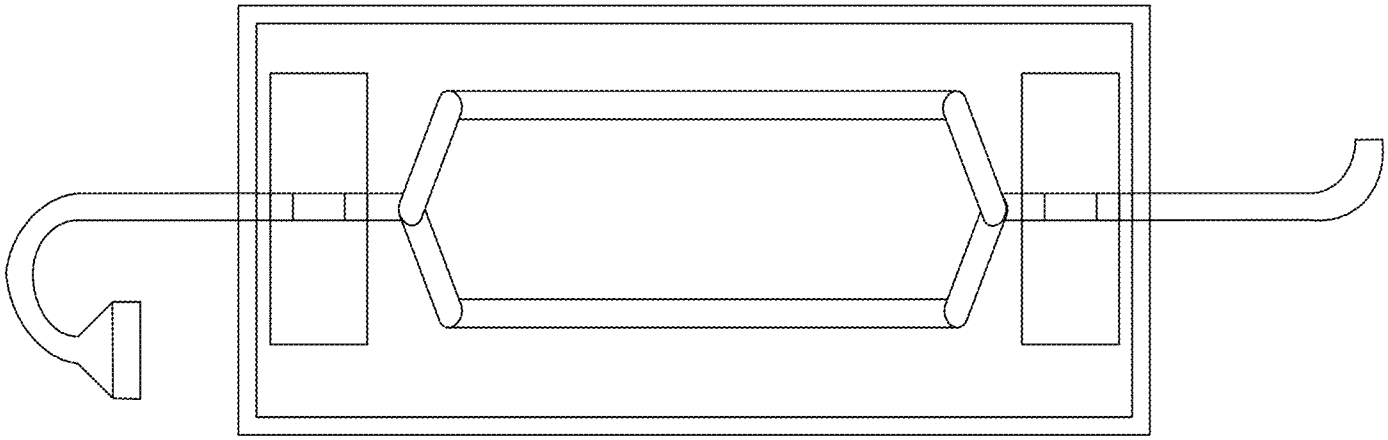
FIG. 3 is a further embodiment of the smoking apparatus.

FIG. 3 illustrates an alternate construction wherein multiple paths through the inner chamber are employed, in this case two paths. More or fewer paths may be employed, and the paths may take different shapes, such as S shapes, wider or narrower pathways, intermediate chambers, or any other shape that provides a desired level of cooling.

Representations in FIGS. 1 through 3 are not to scale and are generally representative of the overall concept, but other constructions are possible. For example, the housing 103 may be cylindrical in shape, but other shapes may be employed. Inhalation element may take various forms, including a mouthpiece or even an additional filter element. Inner chamber 108 may differ in proportional dimension from housing 103. Receptacle 101 and connector 104 may differ in shape, with the ability to create smoke from organic leafy material and provide smoke to the rest of the design and the user. As noted, different amounts of filtration may be provided by the user, where the user may add or remove filter elements as desired in the locations shown.

In one embodiment, piping or tubing may not pass completely through filter 106 or optional second filter 109, but instead may terminate partially in the filter element or chamber with a receiving piping or tubing at the remote end of filter 106 or 108. Such a construction may employ a narrower filter element than shown in FIGS. 1 to 3, and the filter may be longer and narrower than the representations in FIGS. 1 through 3.

Figure 4:
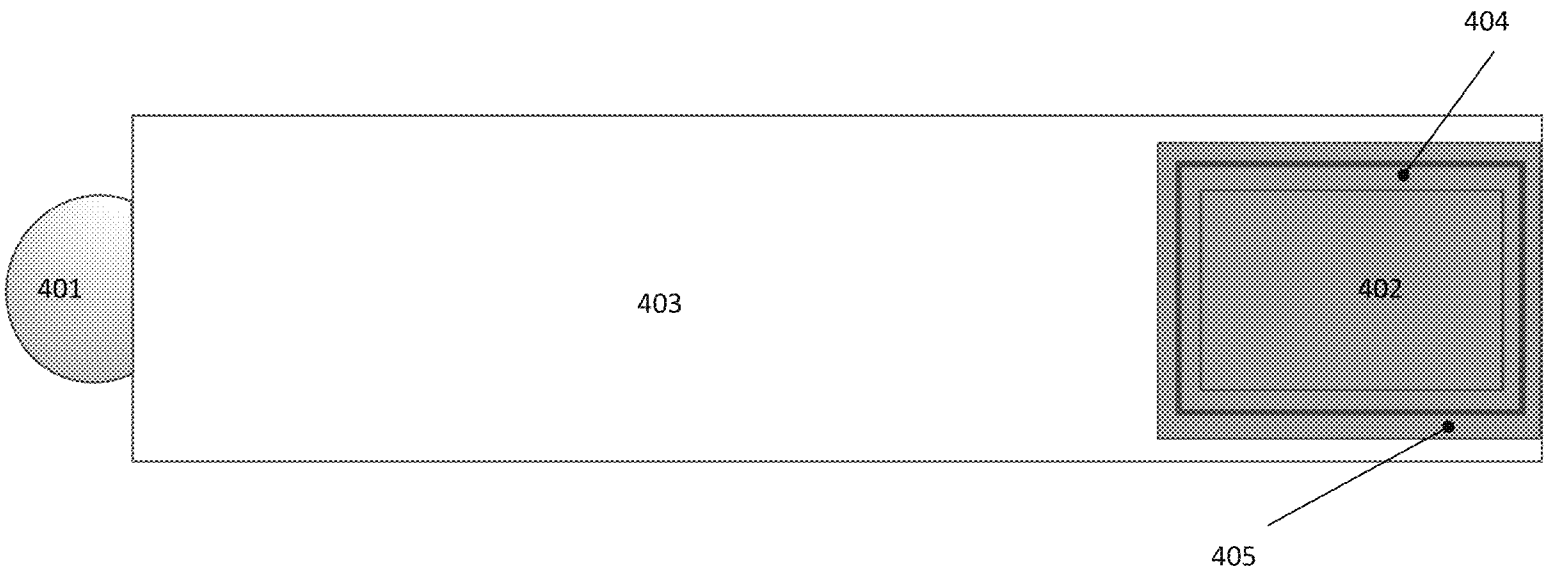
FIG. 4 is a representation of a smoking apparatus in accordance with a further embodiment of the design.

FIG. 4 illustrates a first alternative embodiment of the present design. Housing 403 includes mouthpiece 401 at one end and a lid 402 and insert 404, where the user can move or remove lid 402 to insert and light or combust organic leafy material. Housing 403 may take any shape, including but not limited to triangular, rectangular, square, circular, hexagonal, octagonal, and so forth, as well as an irregular shape, such as narrower in the middle and wider at the ends, flaring from narrower at the mouthpiece end wider at the insert end, or otherwise. Housing 403 may be made from appropriate materials including but not limited to carbon fiber. Edge 405 is shown bordering insert 404 around lid 402 and these components are in a closed orientation. Different shapes of the components illustrated may be provided, and the representation provided is not intended to be limiting. Parts provided may be anodized.

In operation, the user may push down on lid 402, i.e., into the paper in the representation of FIG. 4, and may slide the lid to open, such as leftward toward mouthpiece 401. The user may then slide lid 402 back and lock in in place in the orientation shown.

Figure 5:
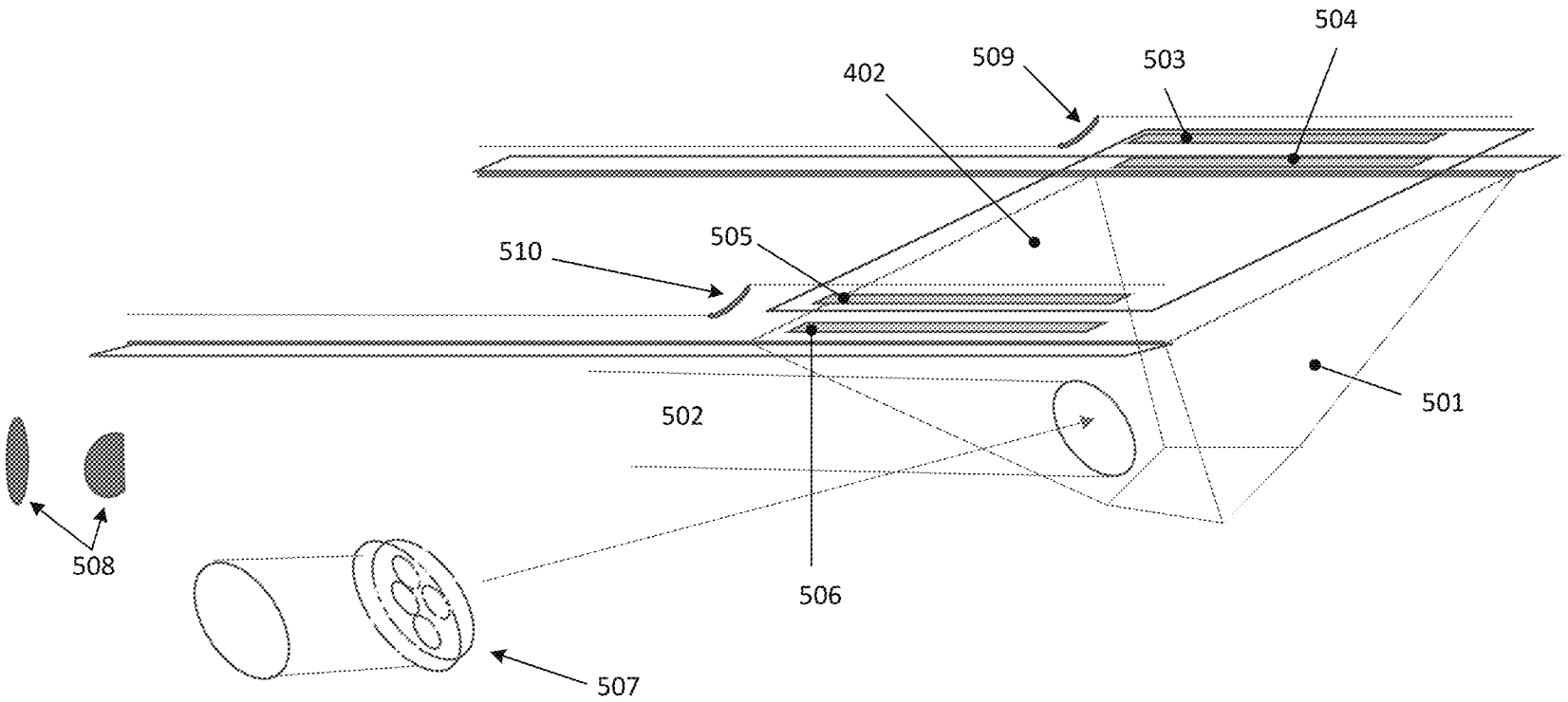
FIG. 5 illustrates an embodiment of the smoking apparatus showing a bowl and lid and employing magnets.

FIG. 5 presents a view of insert 404, including bowl 501, tube 502, and in this embodiment magnet elements 503, 504, 505, and 506. Magnet elements 503 and 504 are of similar polarity, as are magnet elements (each pair may be plus-plus or minus-minus). The user may retract lid 402 by pushing down, such that the pairs of magnets come closer together, and sliding the lid to expose the interior of bowl 501. The user may then provide organic leafy material to bowl 501 and ignite the organic leafy material, and in one embodiment an ignition arrangement may be provided within bowl 501. The user may then slide the lid back into place, at which time the pairs of bar magnets repel one another, holding the lid 402 in place. Tube 502 may extend to mouthpiece using a spiral shape such as is shown in FIGS. 1 and 2 or any other viable manner, for example the representation shown in FIG. 3.

FIG. 5 also includes a sieve insert 507 that prevents non-smoke material from passing to tube 502. The bowl 501 may take different shapes but is typically constructed from a metal, such as titanium, steel, copper, brass, bronze, or aluminum, but other materials may be employed. Also included in FIG. 5 are magnets 508 that may hold the insert within the housing or within the arrangement as necessary.

In FIG. 5, curved elements 509 and 510 are provided to allow for the user to slide lid 402 backward, toward the user, and even remove lid 402 completely if desired. Other arrangements may be employed.

Figure 6:
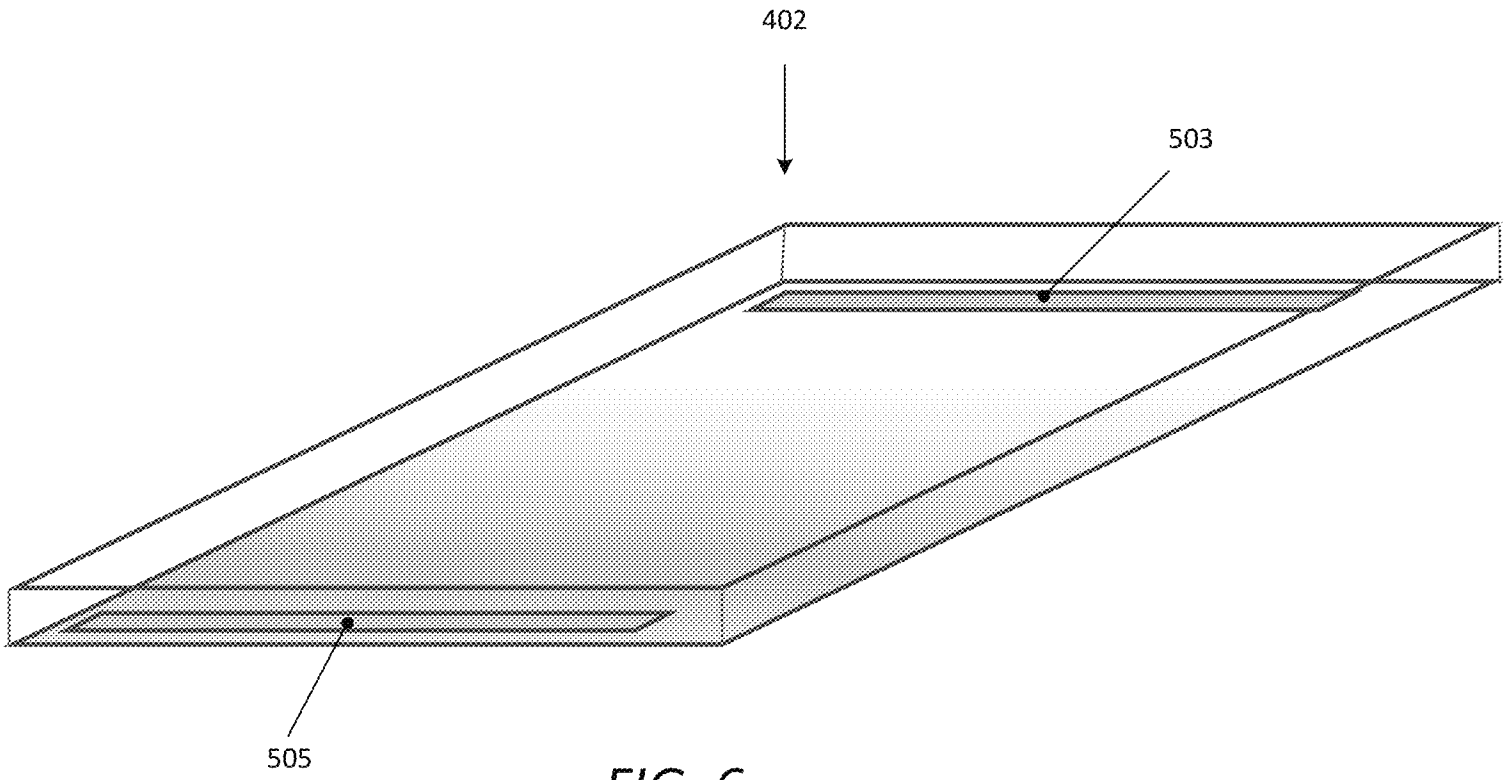
FIG. 6 shows a tray used as a lid in an embodiment of the design.

FIG. 6 illustrates lid 402, with magnets 503 and 505, and lid 402 may take the form of a tray or may be a solid piece, potentially with magnets repositioned, such as on top of the lid. Other forms may be employed. In the embodiment shown in FIG. 6, carbon fiber may be employed on the inside, where the inside is the bottom of the tray arrangement of lid 402. Carbon fiber may be employed within the tray as well, but the general purpose of carbon fiber in this embodiment is to allow combustion and provide a carbon fiber barrier from the combusted organic leafy material.

Figure 7:
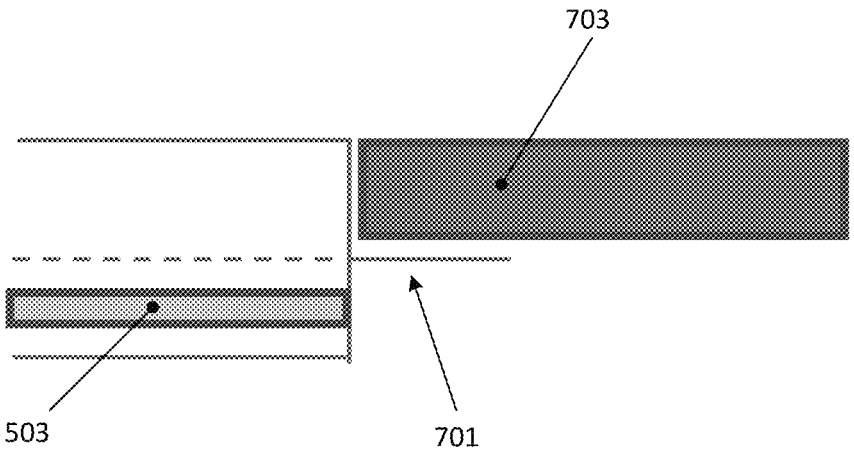
FIG. 7 is a side view of hardware usable to secure and release the lid of FIG. 6.

FIG. 7 is a side view of the attachment arrangement between lid 402 and the mating edge or frame 702 of housing 403, shown as edge 405 in FIG. 4. Lid 402 may include extension 701, with magnet 503 also pictured in lid 402. Magnet 504 is not shown in this representation but may be positioned below tray 402 and magnet 503. Being of same polarity as magnet 503, magnet 504 being attached to tray 402 provides upward force and resultant force contact between extension 701 and mating edge 702. A user can apply downward pressure and can subsequently or concurrently slide lid 402, in this view forward or out of the paper, to open the device such that organic leafy material can be placed in bowl 501, and the lid 402 can be slid in the opposite direction to facilitate closure of the opening.

Figure 8:
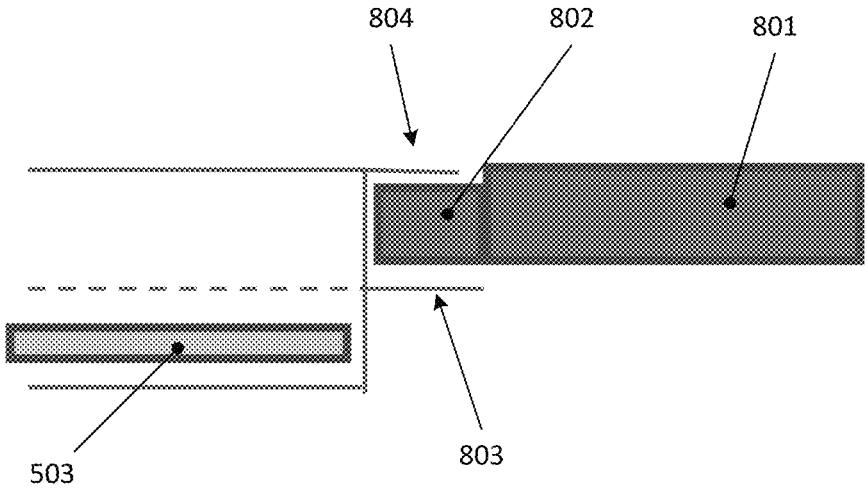
FIG. 8 is an alternate side view of hardware usable to secure and release the lid of FIG. 6.

FIG. 8 is an alternative representation of the mating with a carbon fiber thick stage 801 and a carbon fiber thin stage 802, where lid 402 includes upper extension 803 and lower extension 804. Again, magnet 503 being positioned in lid 402 provides a level of force, and the user may slide the lid forward, out of the paper in the FIG. 7 orientation, without applying a significant amount of downward pressure.

Figure 9:
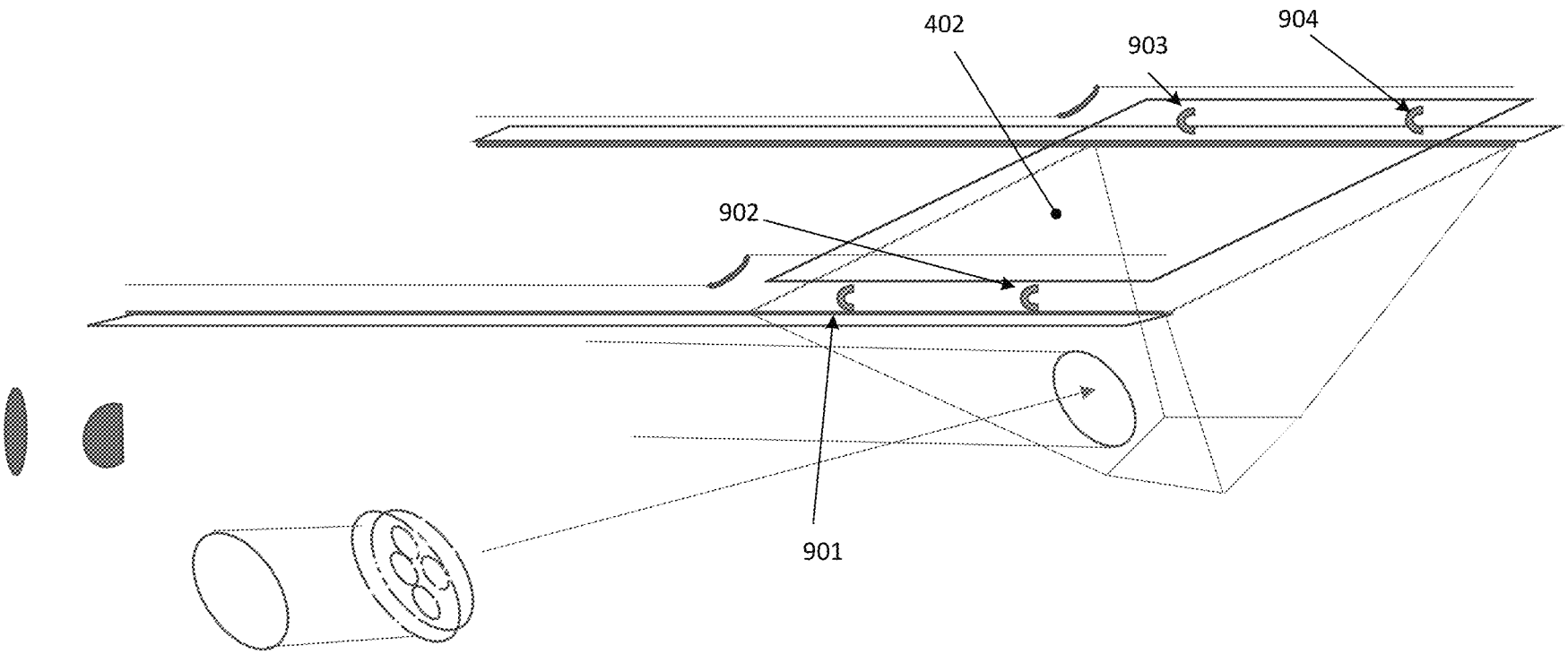
FIG. 9 is an embodiment of the smoking apparatus showing the bowl and the lid and employing spring elements.
Figure 10:
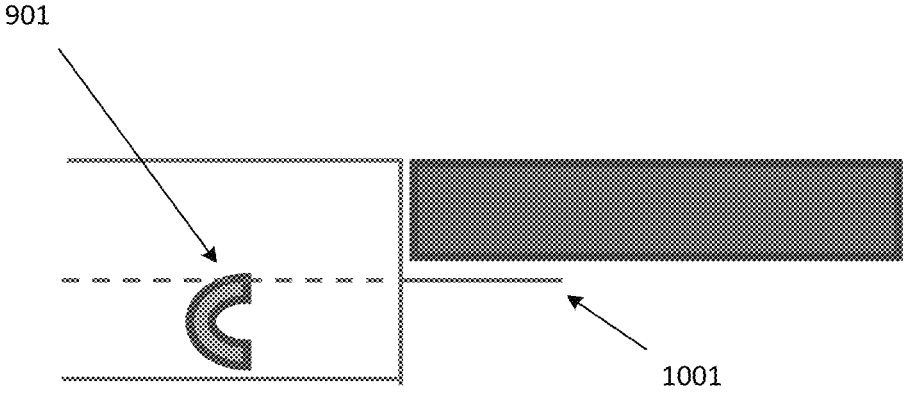
FIG. 10 is a side view of hardware usable to secure and release the lid of FIG. 9.
Figure 11:
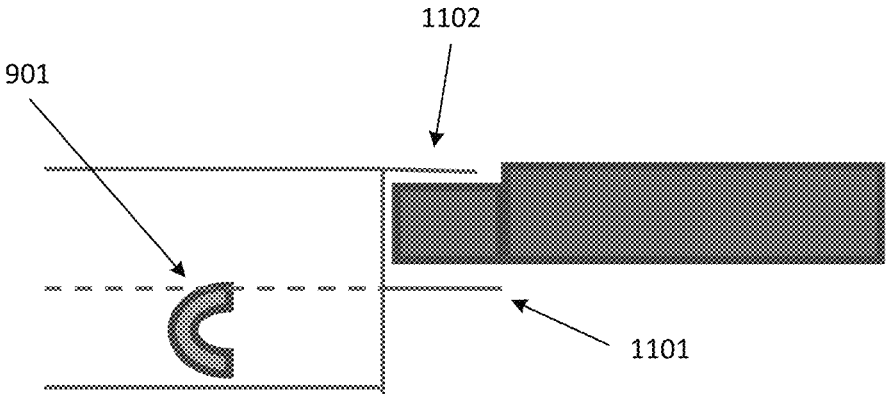
FIG. 11 is an alternate side view of hardware usable to secure and release the lid of FIG. 9.

FIG. 9 provides an alternative employing biasing springs 901, 902, 903, and 904, which hold lid 402 in place until removed. FIGS. 10 and 11 provide side views of the lid 402 and edge or frame 603 of housing 403. FIG. 10 employs a single extension 1001 while FIG. 11 has a carbon fiber thick stage and a carbon fiber thin stage and two extensions 1101 and 1102, and removal of the tray may be similar to the tray removal in that the user may slide the tray to access the bowl 501 beneath. Biasing spring 901 is shown in both FIGS. 10 and 11. Other sliding mechanisms, or even hinged or other opening and closing mechanisms, may be employed.

Figure 12:
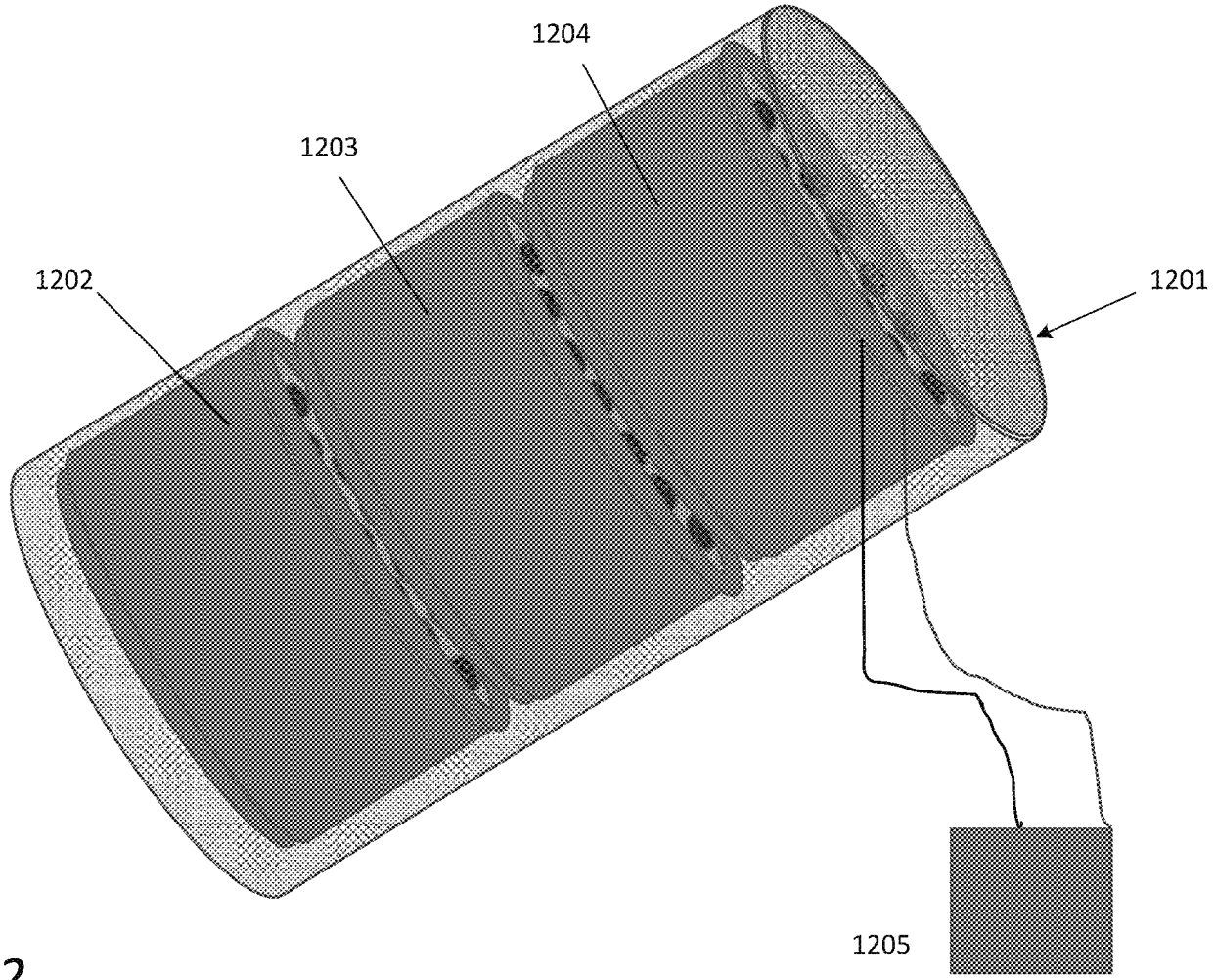
FIG. 12 illustrates an alternate cooling method according to a further embodiment of the present design.

FIG. 12 illustrates an alternative cooling embodiment, specifically an alternative to the calcium chloride, paraffin, or other cooling materials, and also replaces circulating tube 107. Housing 1201 is a heat sink that includes three Peltier metal elements 1202, 1203, and 1204 that include various filters, such as mesh filters, or may include the coiling materials discussed previously, or may include multiple materials, including but not limited to a layer of charcoal above a layer of gauze, such as surgical gauze, with gauze and charcoal or activated charcoal-laced gauze alternating layers throughout the Peltier metal elements 1202, 1203, and 1204. The inside of these Peltier metal elements is cold, and the outside relatively warm, and smoke drawn into the housing containing these Peltier metal elements 1202, 1203, and 1204 may be drawn over and/or pass through the elements, cooling the smoke. Smoke travels between the Peltier metal elements in one embodiment. Battery 1205 is provided to power the Peltier metal materials and/or the heat sink of housing 1201. Water may condense within the housing 1201 and humidify, offering further cooling attributes.

Figure 13:
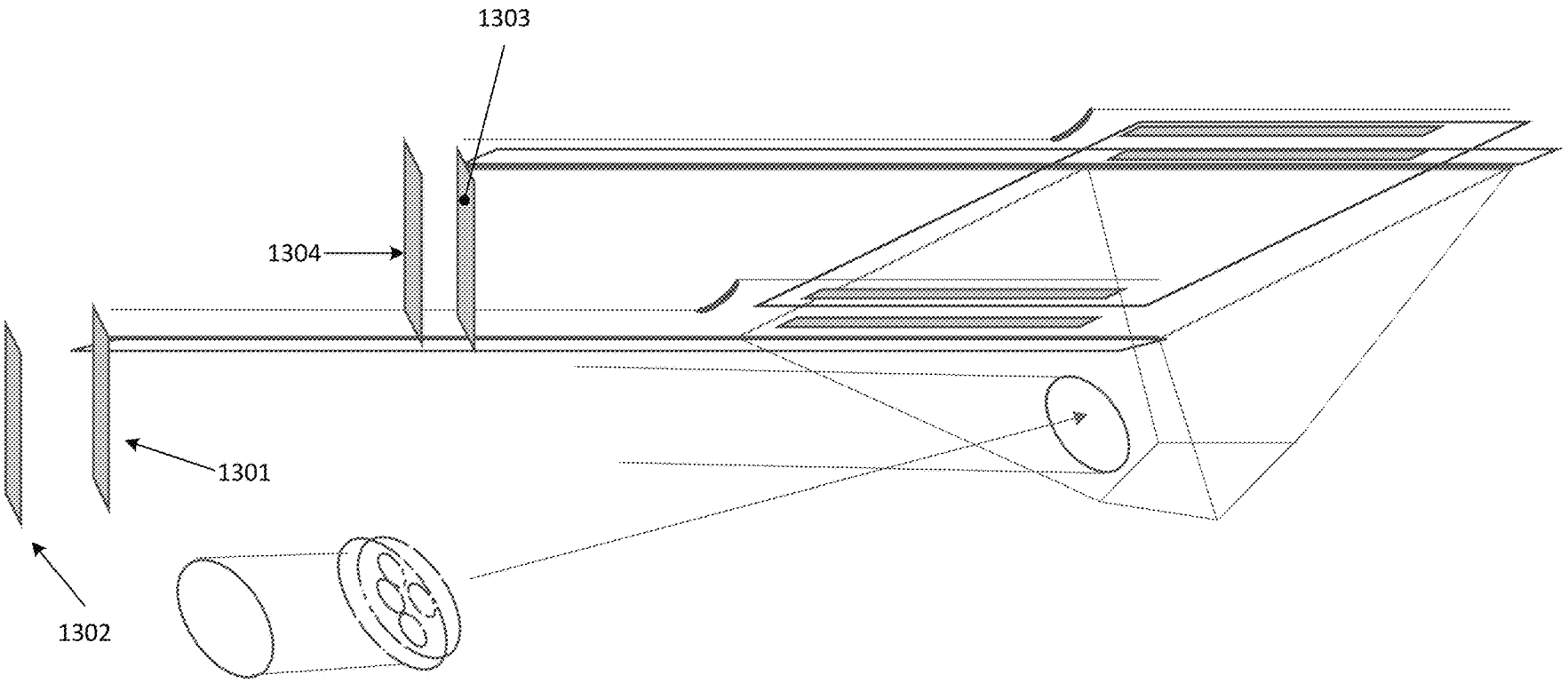
FIG. 13 is a representation of an embodiment of the device employing magnets on the insert and on the bulkhead.

FIG. 13 illustrates a further embodiment of the present design having many of the same components as shown in FIG. 5. The device of FIG. 5, or any embodiment, may be formed of a material such as carbon fiber or PETG (Polyethylene terephthalate glycol), or a combination thereof. Shown in FIG. 13 are magnets used to hold the insert, such as insert 404, to a bulkhead, including four magnets 1301-1304. Magnets may be provided in any orientation to facilitate connection between the components, such as attachment and holding of the insert to the device. One magnet may be placed on the insert and may have one polarity and another may be placed on the bulkhead or housing of the device and have opposite polarity to attract the insert to the bulkhead. Multiple pairs of such magnets may be offered. In the representation of FIG. 13, magnets 1301 and 1303 are placed on the insert and have a first polarity, such as positive, while magnets 1302 and 1304 are located on the bulkhead or housing of the device and have opposite polarity to magnets 1301 and 1303, such as negative.

Figure 14:
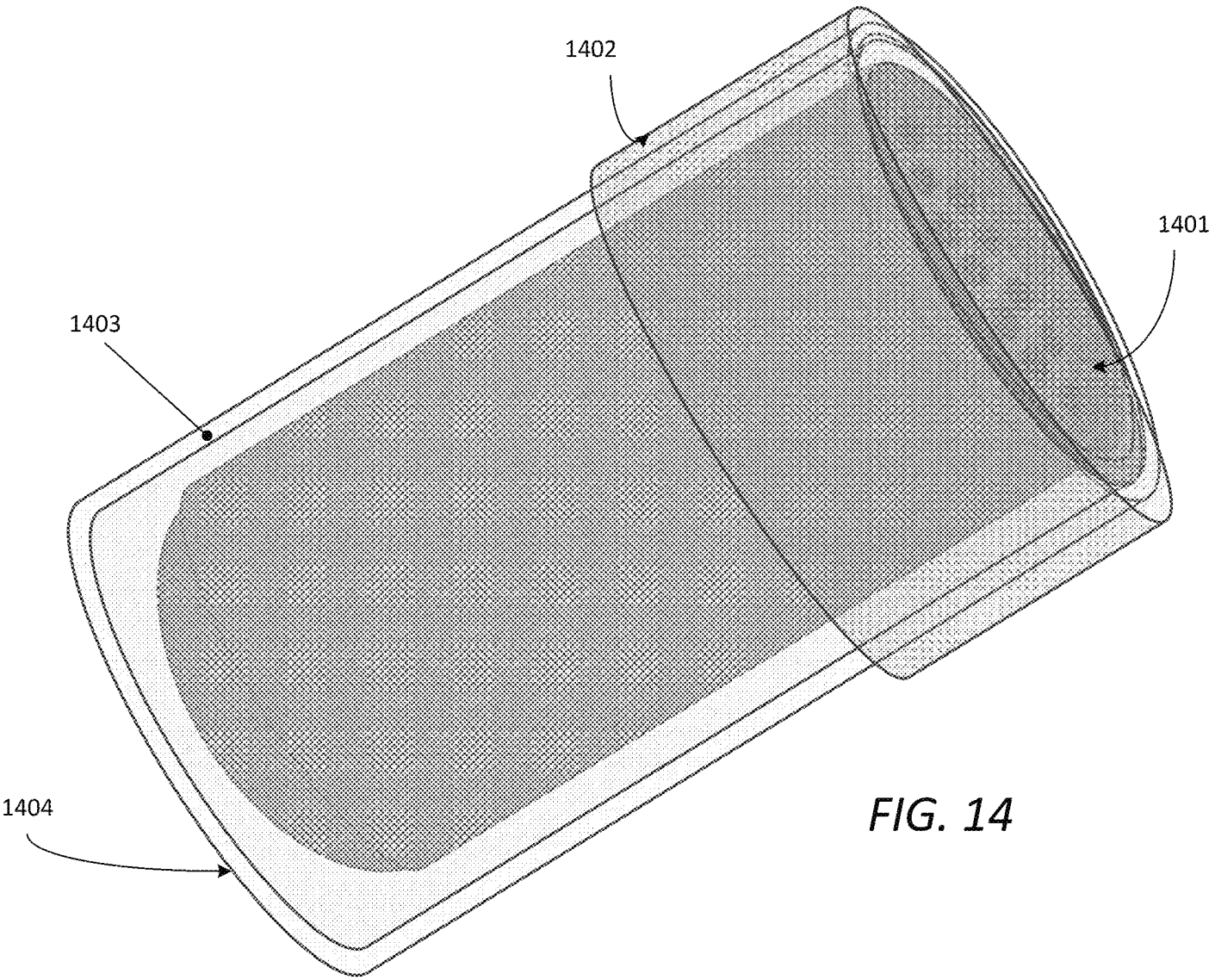
FIG. 14 is a further cooling device embodiment including a sliding magnet design.

FIG. 14 shows an embodiment of an alternate cooling device including inner cylinder 1401, a moderator/filter that includes alternating layers of cotton and activated charcoal, or activated charcoal-laced cotton gauze, for example, and having external shell 1402, representing a sliding magnet, thus forming a gap 1403 that employs magnetocaloric fluid. In operation, the external shell/sliding magnet aligns domains in magnetocaloric fluid (MCF) positioned inside the outermost shell 1404 but outside the inner cylinder 1401. MCF may comprise, for example, $Ni_2Mn$—X, where X is Gallium, Cobalt, Indium, Aluminum, or Antimony Heusler alloys. Sliding the sliding magnet/external shell 1402 toward opposite ends causes domains at previous or initial locations to relax and cool the interior of the moderator/filter of inner cylinder 1401. The movement can be manual or mechanical or can be the result of drawing air or other gasses from the chamber. The magnet aligns domains in a current location, and after movement to a different location continues cooling of the inner cylinder 1401. The interior device or inner cylinder resembles the representation of FIG. 12.

Thus according to one embodiment of the present design, there is provided a smoking apparatus comprising an organic leafy material receptacle configured to receive organic leafy material for ignition, a chamber comprising a circulating tube configured to receive smoke from the organic leafy material receptacle via a passageway, at least one cooling element contacting the circulating tube, the at least one cooling element selected from the group consisting of electric cooling hardware, magnetic cooling hardware, and anhydrous cooling material contacting the circulating tube, and an inhalation tube connected to the chamber and configured to receive cooled smoke from the chamber. A user inhaling from the inhalation tube draws smoke from the organic leafy material receptacle to the circulating tube in the chamber to the inhalation tube and to the user.

According to a further embodiment of the present design, there is provided a smoking apparatus comprising an organic leafy material receptacle configured to receive organic leafy material for ignition, a chamber connected to the organic leafy material receptacle by a connection tube, the chamber comprising a circulating tube configured to receive smoke from the organic leafy material receptacle via the connection tube, at least one cooling element contacting the circulating tube, the at least one cooling element selected from the group consisting of electric cooling hardware, magnetic cooling hardware, and anhydrous cooling material contacting the circulating tube, and an inhalation tube connected to the chamber and configured to receive cooled smoke from the circulating tube. A user inhaling from the inhalation tube draws smoke from the organic leafy material receptacle to the circulating tube in the chamber to the inhalation tube and to the user.

According to another embodiment of the present design, there is provided a smoking apparatus comprising an organic leafy material receptacle configured to receive organic leafy material for ignition, a chamber connected to the organic leafy material receptacle, the chamber comprising a passageway configured to receive smoke from the organic leafy material receptacle, at least one cooling element contacting the passageway, the at least one cooling element selected from the group consisting of electric cooling hardware, magnetic cooling hardware, and anhydrous cooling material, and an inhalation element connected to the chamber and configured to receive cooled smoke from the chamber.

The previous description of the disclosure is provided to enable any person skilled in the art to make or use the disclosure. Various modifications to the disclosure will be readily apparent to those skilled in the art, and the generic principles defined herein may be applied to other variations without departing from the scope of the disclosure. Thus, the disclosure is not intended to be limited to the examples and designs described herein but is to be accorded the widest scope consistent with the principles and novel features disclosed herein.

What is claimed is:

1. A smoking apparatus comprising:

an organic leafy material receptacle configured to receive organic leafy material for ignition;

a chamber comprising:

a circulating tube comprising nitride and plastic, the circulating tube configured to receive smoke from the organic leafy material receptacle via a passageway;

at least one cooling element contacting the circulating tube, the at least one cooling element selected from the group consisting of:

magnetic cooling hardware; and anhydrous cooling material contacting the circulating tube; and an inhalation tube connected to the chamber and configured to receive cooled smoke from the chamber;

wherein a user inhaling from the inhalation tube draws smoke from the organic leafy material receptacle to the circulating tube in the chamber to the inhalation tube and to the user.

2. The smoking apparatus of claim 1, wherein the chamber further comprises a filter positioned between the circulating tube and the organic leafy material receptacle.

3. The smoking apparatus of claim 1, wherein at least a portion of the circulating tube has a circular spiral shape.

4. The smoking apparatus of claim 1, wherein the chamber comprises a plurality of filters.

5. The smoking apparatus of claim 2, wherein the filter comprises one of activated charcoal and activated charcoal-laced fabric.

6. The smoking apparatus of claim 1, wherein the circulating tube is formed of boron nitride-doped plastic.

7. A smoking apparatus comprising:

an organic leafy material receptacle configured to receive organic leafy material for ignition;

a chamber connected to the organic leafy material receptacle by a connection tube, the chamber comprising:

a circulating tube comprising nitride and plastic, the circulating tube configured to receive smoke from the organic leafy material receptacle via the connection tube;

at least one cooling element contacting the circulating tube, the at least one cooling element selected from the group consisting of:

magnetic cooling hardware; and anhydrous cooling material contacting the circulating tube; and an inhalation tube connected to the chamber and configured to receive cooled smoke from the circulating tube;

wherein a user inhaling from the inhalation tube draws smoke from the organic leafy material receptacle to the circulating tube in the chamber to the inhalation tube and to the user.

8. The smoking apparatus of claim 7, wherein the chamber further comprises a filter positioned between the circulating tube and the organic leafy material receptacle.

9. The smoking apparatus of claim 7, wherein at least a portion of the circulating tube has a circular spiral shape.

10. The smoking apparatus of claim 7, wherein the chamber comprises a plurality of filters.

11. The smoking apparatus of claim 8, wherein the filter comprises one of activated charcoal and activated charcoal-laced fabric.

12. The smoking apparatus of claim 7, wherein the circulating tube is formed of boron nitride-doped plastic.

13. A smoking apparatus comprising:

an organic leafy material receptacle configured to receive organic leafy material for ignition;

a chamber connected to the organic leafy material receptacle, the chamber comprising:

a passageway comprising nitride and plastic, the passageway configured to receive smoke from the organic leafy material receptacle;

at least one cooling element contacting the passageway, the at least one cooling element selected from the group consisting of:

magnetic cooling hardware; and anhydrous cooling material; and an inhalation element connected to the chamber and configured to receive cooled smoke from the chamber.

14. The smoking apparatus of claim 13, wherein a user inhaling from the inhalation element draws smoke from the organic leafy material receptacle to the chamber to the inhalation element and to the user.

15. The smoking apparatus of claim 13, wherein the chamber further comprises at least one magnetocaloric element.

16. The smoking apparatus of claim 1, wherein the anhydrous cooling material comprises one of calcium chloride, potassium chloride, glycol, and calcium magnesium acetate.

17. The smoking apparatus of claim 7, wherein the anhydrous cooling material comprises one of calcium chloride, potassium chloride, glycol, and calcium magnesium acetate.

18. The smoking apparatus of claim 13, wherein the anhydrous cooling material comprises one of calcium chloride, potassium chloride, glycol, and calcium magnesium acetate.

* * * * *